United States Patent [19]

Asano et al.

[11] Patent Number: 4,902,151

[45] Date of Patent: Feb. 20, 1990

[54] WRITING INSTRUMENT WITH PLURAL ELEMENTS

[75] Inventors: Katsuo Asano, Ishioka; Shigeo Oka, Tokyo, both of Japan

[73] Assignee: Pentel Kabushiki Kaisha, Tokyo, Japan

[21] Appl. No.: 226,089

[22] Filed: Jul. 29, 1988

[30] Foreign Application Priority Data

Jul. 29, 1987 [JP] Japan ..... 62-116375[U]
Jul. 29, 1987 [JP] Japan ..... 62-116376[U]

[51] Int. Cl.[4] ..... B43K 27/00; B43K 27/08; B43K 23/00

[52] U.S. Cl. ..... 401/34; 401/6; 401/35; 401/88; 401/202

[58] Field of Search ..... 401/34, 35, 6, 88, 202; 446/125

[56] References Cited

U.S. PATENT DOCUMENTS

| | | | |
|---|---|---|---|
| 825,985 | 7/1906 | Schwertenberg | 401/6 |
| 4,026,086 | 5/1977 | Langley | 446/125 X |
| 4,060,952 | 12/1977 | Hernandez | 446/125 X |
| 4,582,447 | 4/1986 | Itoh | 446/125 X |
| 4,702,633 | 10/1987 | Schmidt | 401/35 X |

FOREIGN PATENT DOCUMENTS

| | | | |
|---|---|---|---|
| 357413 | 12/1920 | Fed. Rep. of Germany | 401/35 |
| 2125452 | 12/1972 | Fed. Rep. of Germany | 401/34 |
| 3049467 | 7/1982 | Fed. Rep. of Germany | 401/88 |
| 3504261 | 8/1986 | Fed. Rep. of Germany | 401/35 |
| 707772 | 7/1931 | France | 401/34 |
| 59-184687 | 12/1984 | Japan . | |
| 191868 | 9/1937 | Switzerland | 401/34 |

*Primary Examiner*—Steven A. Bratlie
*Attorney, Agent, or Firm*—Wenderoth, Lind & Ponack

[57] ABSTRACT

Connectable writing instrument composed of two component writing instruments of the same configuration. Each of the component instruments comprises a body, a holder section adapted to hold a pen component at the front end of the body, a front reception hole arranged parallel to the holder section, and a rear reception hole arranged in line with the pen component or with the front reception hole and an engagement projection at the rear of the body. The holder section and the engagement projection engage with the front reception hole and the rear reception hole, respectively, or vice versa.

10 Claims, 3 Drawing Sheets

WRITING INSTRUMENT WITH PLURAL ELEMENTS

BACKGROUND OF THE INVENTION

The present invention relates to a writing instrument, and more particularly, to a writing instrument of the type composed of two component writing instruments of the same configuration which can be connected with each other.

A connectable writing instrument is known in the art and is disclosed in Japanese Utility Model Publication (Unexamined)No. 59-184687, published Dec. 8, 1984. It is composed of two component writing instruments optionally selected from among various writing instruments each of which is provided at the tip of its cap and its tail with both engagement projections and engagement holes. The two instruments selected are detachably connected with each other by fitting the engagement projections of one instrument into the engagement holes of the other.

The above prior art connectable writing instrument enables different types of pen components using inks of different colors to be put into combined use since it is of a construction in which the tips, the tails, or the tip and the tail of two different writing instruments are connected together. On the other hand, engagement projections and engagement holes are formed at the tips of the instrument caps, so that, for example, in the case of a connectable writing instrument in which the tips are connected with each other, one must not only release the connection but must remove the cap before one can use the instrument. One experiences similar bother when using the rear instrument of the type connecting the tail and tip of two instruments.

SUMMARY OF THE INVENTION

An object of the present invention is to provide a connectable writing instrument overcoming the above-mentioned problems. Each of the component instruments of the writing instrument in accordance with the present invention comprises a body portion, a holder section adapted to hold a pen component at the front end of the body, a front reception hole arranged in line either with the pen component or with the front reception hole and an engagement projection both at the rear end of the body portion, the holder section and the engagement projection engaging with the front reception hole and the rear reception hole, respectively, or vice versa.

DETAILED DESCRIPTION OF THE PREFERRED EMBODIMENTS

Figure 1:
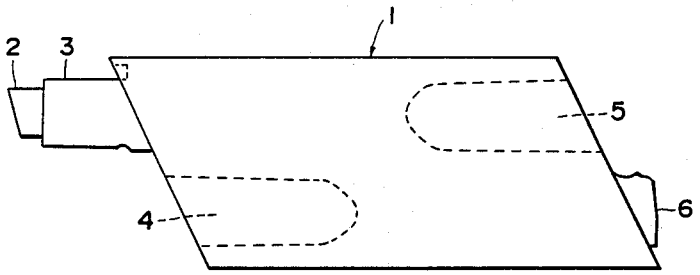
FIG. 1 is a plan view of a writing instrument embodying the present invention.

In FIG. 1 showing a first embodiment of the invention, an instrument body portion 1 made of plastic and the like has an approximately parallelogrammatic plan configuration. The left side of the device as seen in FIG. 1 is designated the front end of the device in this description. On the body portion 1 is formed at its front end, integrally or separately, a holder section 3 adapted to hold a pen component 2 such as a felt pen point, synthetic fiber pen point, a plastic pen point or a ball pen point. The body portion 1 further includes a front reception hole 4 formed parallel to the holder section 3. At the rear end of the body portion 1 are formed a rear reception hole 5 which is in line with a pen component 2 and an engagement projection 6 which is in line with the front reception hole 4. These front and rear reception holes 4 and 5 serve to receive the holder section 3 holding the pen component and the engagement projection 6 of another writing instrument of the same configuration so as to connect the two instruments by engagement.

Figure 2:
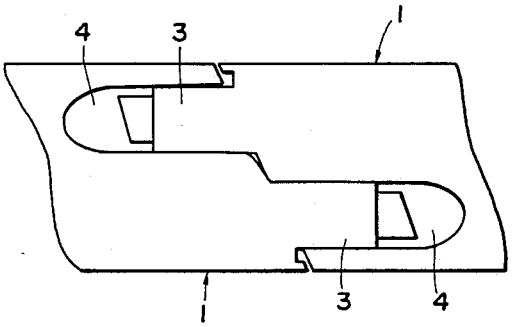
FIGS. 2 to 4 are plan views illustrating how the instruments are to be connected with each other.
Figure 3:
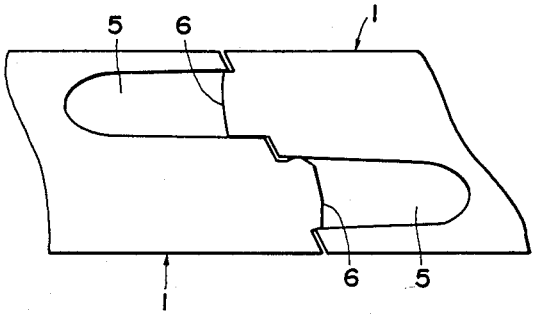
Figure 4:
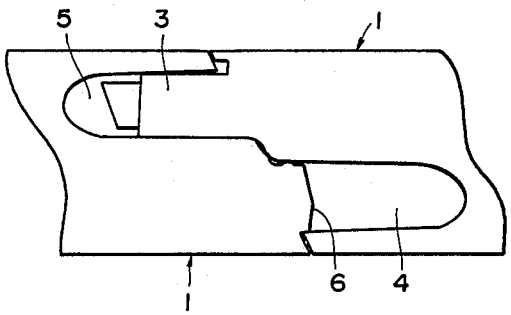

The connection is effected as follows: when the instruments are to be connected at their front ends, their holder sections 3 are engaged with the respective front reception holes 4, as shown in FIG. 2. When the instruments are to be connected at their rear ends, their engagement projections 6 are engaged with the respective rear reception holes 5, as shown in FIG. 3. When the rear end of one instrument is to be connected with the front end of the other instrument, the engagement projection 6 of the former is engaged with the front reception hole 4 of the latter and the holder section 3 of the latter is engaged with the rear reception hole 5 of the former, as shown in FIG. 4.

Figure 5:
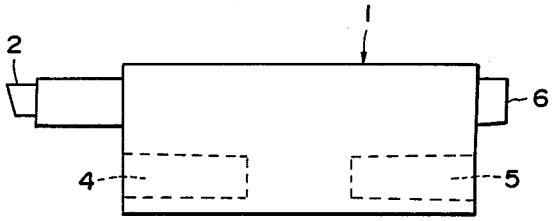
FIGS. 5 and 6 are plan views of writing instruments according to other embodiments of the present invention.

FIG. 5 shows a second embodiment of the invention. This embodiment difffers from that shown in FIG. 1 in that the body portion 1 has an approximately rectangular plan configuration and that the engagement projection 6 is in line with the pen component 2, with the rear reception hole 5 being in line with the front reception hole 4.

Figure 6:
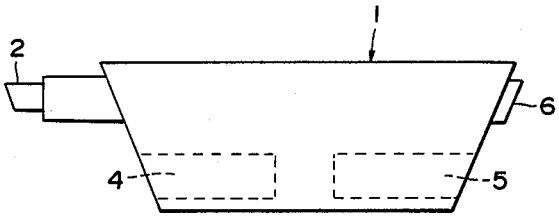

FIG. 6 shows a third embodiment of the invention. This embodiment differs from the embodiment shown in FIG. 1 in that the body portion 1 has an approximately trapezoidal plan configuration and that the engagement projection 6 is in line with the pen component 2 instead of with the rear reception hole 4.

Figure 7:
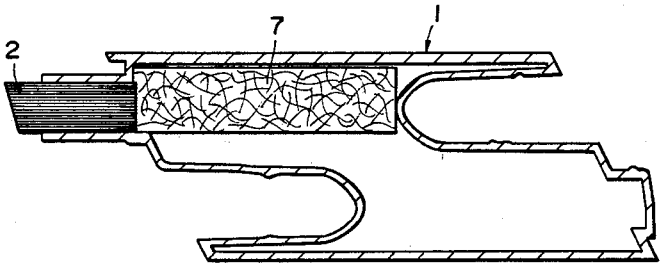
FIGS. 7 and 8 are longitudinally sectioned views of writing instruments according to further embodiments of the invention.
Figure 8:
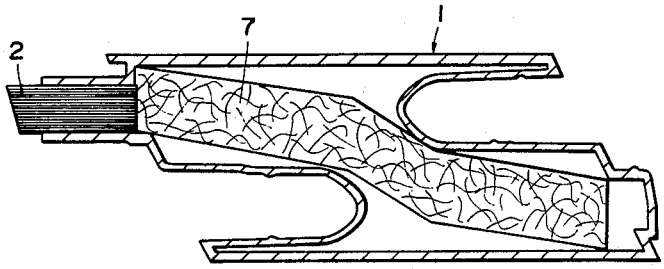

As in the first embodiment of the invention, when a felt pen point, a synthetic fiber pen point or a plastic pen point is used as the pen component 2 in a construction in which the holder section 3 for the pen component 2 is in line with the rear reception hole 5, with the front reception hole 4 being in line with the engagement projection 6, an elastic porous material such as felt, a synthetic fiber bundle, or urethane foam soaked with ink is provided inside the body 1, as is well known in the art. This material soaked with ink may be arranged in the body portion in a straight line, as shown in FIG. 7. However, it may also be arranged in such a manner that it is inclined with respect to the body portion 1, extending from the pen component 2 with which it is in contact. This arrangement enables the inner space of the body 1 to be utilized effectively, i.e., the volume of the material soaked with ink can then be enlarged, thereby increasing the amount of ink soaked up.

As described above, in the construction according to the present invention, the holder section and the front reception hole provided at the front of the body and the rear reception hole and the engagement projection provided at the rear of the body portion are in a specified positional relationship with respect to each other such that it eliminates the above-mentioned problem in using this type of writing instrument and enables it to be used after connecting together the front ends, the rear ends, or the front and rear ends of the two instruments composing the connectable writing instrument.

While the invention has been described in the specification and illustrated in the drawings with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention will not be limited to the particular embodiment illustrated by the drawings contemplated for carrying out the present invention, but that the invention will include any embodiments falling within the scope of the appended claims.

What is claimed is:

1. A connectable writing instrument comprising at least two component writing instruments of the same configuration, each of said at least two component writing instruments including:

a body portion having front and rear ends, and a longitudinal axis;

a holder section attached to said front end of said body portion, means on said holder section for holding a pen component, and the longitudinal axis of said holder section extending substantially parallel to the longitudinal axis of said body portion;

a pen component held in said means for holding a pen component;

a front a reception hole defined in said front end of said body portion, and the longitudinal axis of said front reception hole being substantially parallel to the longitudinal axis of said holder section;

a rear reception hole defined in said rear end of said body portion, and the longitudinal axis of said rear reception hole being colinear with the longitudinal axis of said holder section;

an engagement projection attached to said rear end of said body portion, and the longitudinal axis of said engagement projection being colinear with the longitudinal axis of said front reception hole;

attaching means on said body portion for detachably engaging each one of said holder section and said engagement projection alternatively with each one of said front and rear reception holes; and wherein, said holder section of a first one of said at least one two component writing instruments is received in the front reception hole of a second one of said at least two component writing instruments when the holder section of the second one of said at least two writing instruments is received in the front reception hole of the first one of said at least two component writing instruments, said holder section of a first one of said at least two component writing instruments is received in the rear reception hole of a second one of said at least two component writing instruments when the engagement projection of the second one of said at least two component writing instruments is received in the front reception hole of the first one of said at least two component writing instruments, and said engagement projection of the first one of said at least two component writing instruments is received in the rear reception hole of the second one of said at least two component writing instruments when the engagement projection of the second one of said at least two component writing instruments is received in the rear reception hole of the first one of said at least two writing instruments.

2. A connectable writing instrument according to claim 1, wherein said body portion has a trapezoidal configuration.

3. A connectable writing instrument according to claim 2, wherein said body portion includes therein an elastic porous material soaked with ink.

4. A connectable writing instrument according to claim 3, wherein said elastic porous material is arranged in the body in a straight line.

5. A connectable writing instrument comprising at least two component writing instruments of the same configuration, each one of said at least two component writing instruments including:

a body portion having front and rear ends, and a longitudinal axis;

a holder section attached to said front end of said body portion, means on said holder section for holding a pen component, and the longitudinal axis of said holder section extending substantially parallel to the longitudinal axis of said body portion;

a pen component held in said means for holding a pen component;

a front reception hole defined in said front end of said body portion, and the longitudinal axis of said front reception hole being substantially parallel to the longitudinal axis of said holder section;

a rear reception hole defined in said rear end of said body portion, and the longitudinal axis of said rear reception hole being colinear with the longitudinal axis of said front reception hole;

an engagement projection attached to said rear end of said body portion, and the longitudinal axis of said engagement projection being colinear with the longitudinal axis of said holder section;

attaching means on said body portion for detachably engaging each one of said holder section and said engagement projection alternatively with each one of said front and rear reception holes; and wherein, said holder section of a first one of said at least two component writing instruments is received in the front reception hole of a second one of said at least two component writing instruments when the holder section of the second one of said at least two writing instrument is received in the front reception hole of the first one of said at least two component writing instruments, said holder section of a first one of said least two component writing instruments is received in the rear reception hole of a second one of said at least two component writing instruments when the engagement projection of the second one of said at least two component writing instruments is received in the front reception hole of the first one of said at least two component writing instruments, and said engagement projection of the first one of said at least two component writing instruments is received in the rear reception hole of the second one of said at least two component writing instruments when the engagement projection of the second one of said at least two component writing instruments is received in the rear reception hole of the first one of said at least two writing instruments.

6. A connectable writing instrument according to claim 5, wherein said body portion has a rectangular configuration.

7. A connectable writing instrument according to claim 6, wherein said body portion includes therein an elastic porous material soaked with ink.

8. A connectable writing instrument according to claim 7, wherein said elastic porous material is arranged inclined with respect to said body portion so that said material extends from said pen component.

9. A connectable writing instrument comprising at least two component writing instruments of the same configuration, each one of said at least two component writing instruments including:

a body portion having front and rear ends, and a longitudinal axis;

a holder section attached to said front end of said body portion, means on said holder section for holding a pen component, and the longitudinal axis of said holder section extending substantially parallel to the longitudinal axis of said body portion;

a pen component held in said means for holding a pen component;

a front reception hole defined in said front end of said body portion, and the longitudinal axis of said front reception hole being substantially parallel to the longitudinal axis of said holder section;

a rear reception hole defined in said rear end of said body portion, and the longitudinal axis of said rear reception hole being colinear with the longitudinal axis of said holder section;

an engagement projection attached to said rear end of said body portion, and the longitudinal axis of said engagement projection being colinear with the longitudinal axis of said front reception hole;

attaching means on said body portion for detachably engaging each one of said holder section and said engagement projection alternatively with each one of said front and rear reception holes;

an elastic porous material soaked with ink, in fluid communication with said pen component, and received in and inclined with respect to said body portion; and wherein, said holder section of a first one of said at least two component writing instruments is received in the front reception hole of a second one of said at least two component writing instruments when the holder section of the second one of said at least two writing instruments is received in the front reception hole of the first one of said at least two component writing instruments, said holder section of a first one of said at least two component writing instruments is received in the rear reception hole of a second one of said at least two component writing instruments when the engagement projection of the second one of said at least two component writing instruments is received in the front reception hole of the first one of said at least two component writing instruments, and said engagement projection of the first one of said at least two component writing instruments is received in the rear reception hole of the second one of said at least two component writing instruments when the engagement projection of the second one of said at least two component writing instruments is received in the rear reception hole of the first one of said at least two writing instruments.

10. A connectable writing instrument according to claim 9, wherein said body portion has a parallelogrammatic configuration.

* * * * *